US007073788B2

(12) United States Patent
Donges et al.

(10) Patent No.: US 7,073,788 B2
(45) Date of Patent: Jul. 11, 2006

(54) PROTECTIVE DEVICE FOR A DELIVERY DEVICE

(75) Inventors: Markus Donges, Mannheim (DE); Helmut Meyer, Wiesloch (DE); Robert Mueller, Moerlenbach (DE); Holger Scholz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/643,620

(22) Filed: Aug. 19, 2003

(65) Prior Publication Data

US 2004/0075212 A1 Apr. 22, 2004

(30) Foreign Application Priority Data

Aug. 22, 2002 (DE) ..... 102 38 488

(51) Int. Cl.
*B65H 31/00* (2006.01)

(52) U.S. Cl. ..... 271/207; 101/232; 101/479; 101/480

(58) Field of Classification Search ..... 271/207, 271/213, 198, 204; 400/54, 578, 693; 162/140; 101/232, 479, 480
See application file for complete search history.

(56) References Cited

U.S. PATENT DOCUMENTS

| | | | | |
|---|---|---|---|---|
| 3,846,816 | A * | 11/1974 | Gaisser | 396/589 |
| 6,006,670 | A | 12/1999 | Bantlin et al. | 101/494 |
| 6,419,220 | B1 | 7/2002 | Pollich | 271/3.17 |
| 6,427,586 | B1 * | 8/2002 | Takahashi | 101/116 |
| 6,644,192 | B1 * | 11/2003 | Dilling et al. | 101/480 |

FOREIGN PATENT DOCUMENTS

| | | |
|---|---|---|
| DE | 19701645 | 7/1998 |
| DE | 19925065 | 7/2000 |

* cited by examiner

*Primary Examiner*—Kathy Matecki
*Assistant Examiner*—Thomas Morrison
(74) *Attorney, Agent, or Firm*—Davidson, Davidson & Kappel, LLC

(57) ABSTRACT

A method for operating a machine that processes printing substrates in sheet form, in particular, a printing press, including a delivery device (1) which contains a drive (2) for conveying the substrate sheets and at least one opening (8) through which the substrate sheets are conveyed from the inside (4) of the delivery device (1) to an externally accessible region (6), and further including a control device which controls at least one closing device (7) for opening or closing the opening (8) and which is operatively connected to the drive (2) of the delivery device (1). Also provided is a device for carrying out the method. The present invention has the feature that the opening (8) is closed or is closed by the control device when no substrate sheet is conveyed through the opening (8).

16 Claims, 3 Drawing Sheets

PROTECTIVE DEVICE FOR A DELIVERY DEVICE

Priority to German Patent Application No. 102 38 488.6, filed Aug. 22, 2002 and hereby incorporated by reference herein, is claimed.

BACKGROUND INFORMATION

The present invention relates to a method for operating a machine that processes printing substrates in sheet form, in particular, a printing press, including a delivery device which contains a drive for conveying the substrate sheets and at least one opening through which the substrate sheets can be conveyed from the inside of the delivery device to an externally accessible region, and further including a control device which controls at least one closing device for opening or closing the opening and which is operatively connected to the drive of the delivery device. Moreover, the present invention relates to a device for carrying out the specified method mentioned.

Sheet-fed rotary printing presses are essentially composed of three units: the feeder for feeding substrate sheets into the printing press, the printing units for printing on the substrate sheets, and the delivery device for outputting the printed substrate sheets. In this context, the substrate sheets is usually deposited on a pile in the delivery device which, when it reaches a certain height, it removed so that a new delivery pile is built up. Therefore, a central task of the delivery device is to convey the substrate sheets from the last printing unit or a drying unit or varnishing unit to the delivery pile. For this purpose, most delivery devices have movable gripper bridges which convey the substrate sheets and deposit them on the delivery pile when reaching the pile. Therefore, the delivery device should have an opening in the region above the delivery pile through which the substrate sheets can get from the inside of the delivery device to the delivery pile. The delivery pile, in turn, must be accessible to the operating personnel because the pile needs to be regularly changed. Therefore, there is a risk of the operating personnel bringing the head, torso or limbs into contact with dangerous parts, in particular with the gripper bridges, inside the delivery device through the opening. Therefore, there are safety regulations, also on the part of the workers' compensation associations, which are intended to contribute to the prevention of potential injuries in the region of the delivery devices.

Currently, the hazard is sought to be prevented primarily by generating audible and visual warning signals during the starting of the delivery device and the printing press. In this context, however, there is always the risk that the warning signals are not heard or seen, as a result of which the risk to the operating personnel continues.

A method for increasing the operational safety in the region of the delivery device of a printing press is known from German Patent Application No. DE 199 25 065 A1. This patent application is based on the idea of monitoring the externally accessible free space below an outlet opening of the delivery device in such a manner that this free space does not exceed a certain predetermined amount. In this context, this amount has to be kept so small that the operating personnel cannot get into contact with dangerous moving parts of the delivery device during the operation thereof. Thus, in particular, the operating personnel is prevented from reaching into operating gripper bridges. In this context, the monitoring of the free space takes place in such a manner that in the region below the opening of the delivery device, a movable pile board is located on which are deposited printed sheets comimg from inside the delivery device through the opening. The more sheets are deposited, the higher the pile, requiring the movable pile board to be correspondingly lowered. In this context, however, the pile board, while controlled by a monitoring sensor, is lowered only so far that the free space between the top edge of the pile of printed sheets and the opening of the delivery device does not exceed the prescribed safety level. As soon as the amount of free space that is only just safe is determined to be exceeded, the main drive of the printing press, which also drives the delivery device via gear wheels or shafts, is stopped. Restarting the printing presses along with the delivery device is only possible if the free space has in the meantime been reduced to the prescribed amount. In one embodiment of German Patent Application No. DE 199 25 065 A1, provision is also made for a roller shutter to be mounted below the opening of the delivery device in order to limit the free space. Such a roller shutter is retracted to the height of the maximum admissible free space and thus, while in the closed state, allows the printing press to be put into operation again along with the delivery device even if the top edge of the pile is too far away from the opening.

The design of a safety system on the delivery device known from German Patent Application No. DE 199 25 065 A1 offers far-reaching protection of operating personnel from injury from rotating parts of the delivery device. However, this design approach has the crucial disadvantage that the delivery device and the printing press are always stopped when the maximum admissible free space is exceeded. After that, the printing press must then be restarted in the prescribed manner. However, stopping the whole machine is very unpopular with the operating personnel due to the corresponding expenditure of time.

BIREF SUMMARY OF THE INVENTION

It is an object of the present invention to provide a method and device that prevents unnecessary stopping of the printing press and the delivery device.

The present invention provides a method for operating a machine that processes printing substrates in sheet form, in particular, a printing press, including a delivery device (1) which contains a drive (2) for conveying the substrate sheets and at least one opening (8) through which the substrate sheets are conveyed from the inside (4) of the delivery device (1) to an externally accessible region (6), and further including a control device which controls at least one closing device (7) for opening or closing the opening (8) and which is operatively connected to the drive (2) of the delivery device (1). The opening (8) is closed or is closed by the control device when no substrate sheet is conveyed through the opening (8). A related device is also provided.

Using the method and the device of the present invention, the operating personnel at the printing presses can be reliably protected from injury from rotating parts of the delivery device while at the same time preventing unnecessary shutdown of the printing press. To this end, the drive of the delivery device is directly connected to a control device that monitors safety at the opening of the delivery device. The drive is understood to be electrical, hydraulic, pneumatic, or other types of drives, including also the main drive of a printing press if the delivery device is also driven by the main drive via gear wheels or shafts, and may include a plurality of separate subdrives. Moreover, the drive also includes the driven moving parts, such as gripper bridges or conveyor belts. In this context, the control device monitors the state of the opening, i.e., whether or not a substrate sheet is being conveyed through the opening. If no substrate sheet is conveyed through the opening, the control device ensures that the opening is closed by a closing device or, when already closed, that it remains closed. There is no need to stop the drive of the delivery device during the process, so that no machine shutdown occurs.

This works both with delivery devices having separate drives that drive only the moving parts of the delivery device and with printing presses in which the drive of the delivery device is also mechanically driven by the main drive of the printing press. Thus, it makes no difference whether the printing press works with a mechanical gear train or only individual drives. The only important thing is to have information about the operating state of the drive and to be able to transmit the information to the control device. In any case, the present invention eliminates the need for intervention in the drive of the delivery device to shut it down, but nevertheless offers reliable protection from injury in that the closing device reliably closes the dangerous opening of the delivery device.

In one embodiment of the present invention, the opening is closed or opened manually or using an operating control element, in connection with which the opening is opened only when the drive is at rest, or the drive is put into operation only when the opening is closed. In this embodiment, the opening can be manually opened by the operating personnel for maintenance purposes or, if the closing device is motor-driven, it can be opened using a suitable operating control element, provided that the drive of the delivery device is at rest. Thus, when the control device closes the opening because no substrate sheets are conveyed therethrough, then the opening can be manually reopened after shutdown of the delivery device to make it easier to reach into the inside of the delivery device for maintenance purposes. However, if the operating control element or a lever for manual opening is operated while the machine is running, then the opening remains closed, preventing dangerous manipulations.

In a further embodiment of the present invention, provision is made for the opening to be opened by the control device as soon as a substrate sheet is conveyed through the opening, or to remain open when a printing substrate protrudes through the opening. When a printing press is put into operation along with the delivery device, it takes a certain time until the first printed substrate sheets have passed through the printing units of a printing press. In this phase, the opening of the delivery device must be closed by the control device for the safety of the operating personnel. However, the present embodiment ensures that the opening of the delivery device is cleared for transport purposes as soon as the first printed substrate sheets have reached the opening of the delivery device. That is, the opening of the delivery device is opened only when printing substrates are actually conveyed therethrough. However, when printing substrates are conveyed they block a large part of the opening of the delivery device, thus preventing the operating personnel from reaching into the delivery device. If, for any reason, the delivery device is shut down while the transport of the substrate sheets is in progress, then remaining printing substrates may still protrude through the opening. In this case too, the present embodiment ensures that the opening remains open and the printing substrates present in the opening are not crumpled by closing the opening.

Moreover, in a further embodiment, provision is made that the closing device is adapted as a function of the format and that, during the transport of substrate sheets, the opening is open or opened by the control device only to the extent required by the width or length of the substrate sheet. This embodiment offers the great advantage that here the opening is in fact always only as large as really necessary for the substrate sheets. Since almost all printing presses and therefore also delivery devices work with substrate sheet formats of different size, a gap would result between the printing substrate and the opening in the case of smaller formats, the operating personnel possibly still being able to reach through the opening into the dangerous inside of the delivery device. In this embodiment, in order to ensure that reaching into the inside of the delivery device is also prevented when working with smaller substrate sheet formats than the maximum possible format, the closing device is adapted to the specific sheet format that has been set, the format being automatically set by the control device by detecting the sheet format using sensors during the transport through the delivery device, or by accessing the machine control of the printing press and using the format stored therein. It is also conceivable to set the format manually, in which case the machine, after comparison with the form stored, for example, in the machine control for the delivery device, starts only when the correct format has been set.

In another embodiment of the present invention, provision is made for the opening to remain open or be opened by the control device after the drive of the machine that processes printing substrates in sheet form have come to a stop. Such a method offers the advantage that the operating personnel have immediate access to the inside of the delivery device when the delivery device is at rest without having to operate the closing device of the opening of the delivery device in advance.

Further advantages are achieved in that the opening is closed or is closed by the control device before the drive of the delivery device is put into operation. This embodiment ensures that the opening is closed also when the delivery device has been at rest and is put into operation. If no substrate sheet protrudes through the opening, a reaching into the inside of the delivery device is thus prevented because this embodiment of the present invention ensures that the opening of the delivery device is closed first before moving parts inside the delivery device are set in motion. This provides a particularly secure protection from reaching into the delivery device in a dangerous manner.

In another embodiment of the present invention, provision is made that, in the case of format-dependent adjustment of the closing device, the control device opens the opening wider when the drive of the delivery device is at rest and printing substrates protrude through the opening from the inside to the outside of the delivery device. When working with a format-dependent closing device, it is important for maintenance that the opening of the delivery device is open as wide as possible when the drive is at rest and printing substrates protrude from the inside to the outside of the delivery device. In this manner a paper jam inside the delivery device can be easily removed.

Moreover, provision is made for sensors or contacts to be provided at the closing device to detect the state thereof. To be able to effectively operate the control device of the present invention and the associated method, the control device device must always know the state of the closing device. This can easily be accomplished using contacts and sensor that inform the control device of whether the closing device is open or closed, or if it is in a position in between, for example, in the case of format-dependent adjustment of the opening. In this manner, the closing device is integrated in the safety circuit of the control device.

If sensors or contacts for detecting substrate sheets are present in the region of the closing device, then this offers the advantage that the control device receives reliable signals of whether or not a substrate sheet is currently present in the opening. This ensures that the opening is closed when no printing substrate is conveyed through the opening, and that the opening is completely or partially open when such a substrate is conveyed through the opening.

In another embodiment, provision is made for the closing device to include at least one movable closing element that is controllable by the control device. This movable closing element opens or closes the opening of the delivery device as a function of the control signals emitted by the control device. It is not crucial whether the closing device actuates the movable closing element pneumatically, hydraulically or electrically, as long as the closing device is able to communicate with the control device. The movable closing element can close the opening of the delivery partially, completely or not at all, depending on the command that is currently issued by the control device.

Furthermore, provision is made for the closing device to include at least two movable closing elements that are controllable by the control device. Such a device has the great advantage of allowing format-dependent adjustment of the opening of the delivery device to the substrate sheets to be transported. Since the substrate sheets usually have a rectangular shape, it is possible to set any desired rectangular format using at least two closing elements. If three or four closing elements are present, the format-dependent clear width inside the opening can be arbitrarily positioned within the opening and thereby matched to gripper bridges and the drive inside the delivery device. For example, if the substrate sheets are not transported exactly centrally by gripper bridges inside the delivery device and therefore not conveyed exactly centrally through the opening to the outside either, the clear width of the opening must be moved from the center to the right or to the left accordingly. It can also be convenient for the clear width of the opening to be changed in the direction of the transport direction of the substrate sheets if the position of the delivery pile below the opening of the delivery device in this direction changes.

Advantageously, the movable closing element is a roller shutter-like object. Roller shutter-like objects have the advantage over rigid closing elements that they do not require more space during opening than in the closed state. Therefore, roller shutter-like closing elements can be mounted on the delivery device in a particularly space-saving manner.

BRIEF DESCRIPTION OF THE DRAWINGS

The present invention is now described and illustrated in greater detail with reference to several Figures. Further advantageous embodiments can be gathered from the Figures, in which.

DETAILED DESCRIPTION

Figure 1:
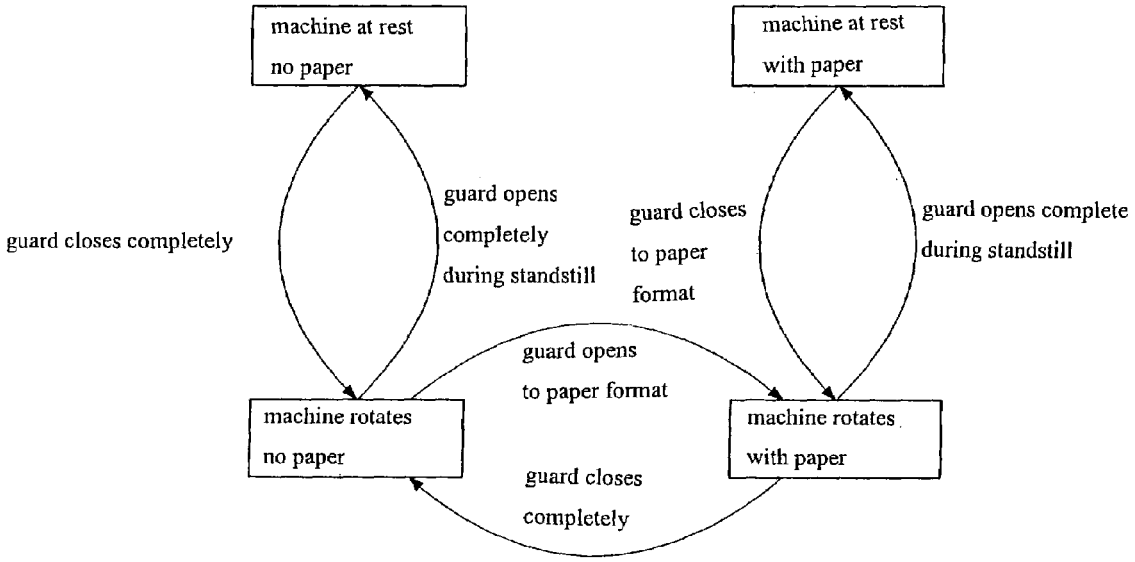
FIG. 1 shows a flow chart of the method according to the present invention.

The flow chart in FIG. 1 shows the opening and closing of a closing device 7 at a delivery device 1 (FIG. 3) if the control of closing device 7 depends only on the control of the paper-processing machine. In FIG. 1, the term "machine" includes drive 2 of delivery device 1. This means that when the machine is at rest, delivery device 1 is also at rest. In this context, delivery device 1, or the machine, has four states, in which the machine either rotates or is at rest, and paper either is or is not conveyed through an opening 8 of delivery device 1. In the first state at the top left of FIG. 1, the machine is at rest and no material is conveyed through opening 8. Since it always takes a certain time for the first sheets to get from the feeder of a printing press through the printing units to delivery device 1, initially no sheets are conveyed through opening 8 when the machine begins to move. This is the second state of the machine, in which the machine rotates and no paper is conveyed through opening 8. During the transition from the first state to the second state of the machine, closing device 7, which is referred to as "guard" in FIG. 1, is therefore completely closed. In this manner, it is ensured that no operating personnel can reach into the inside of delivery device 1 with their body parts. Conversely, during the transition from the second state of the machine to the first state of the machine, the guard, i.e., closing device 7, is completely opened, allowing maintenance work to be carried out on the machine at rest in an unhindered manner. In this context, it is important that the guard opens only when the machine is already at rest.

In a third state, the machine rotates and paper is conveyed through opening 8. In this state, the first sheets have reached opening 8 of delivery device 1 so that closing device 7 clears opening 8 to such an extent that sheets can be conveyed from the inside of delivery device 1 to the outside region 6 of delivery device 1. To this end, during the transition from the second state to the third state, closing device 7 advantageously opens to such an extent that the sheets can exit delivery device 1 in an unhindered manner. Conversely, during the opposite transition from state three to state two, the guard is completely closed so that the operating personnel cannot reach into the inside of delivery device 1 with body parts after the flow of sheets through opening 8 stops.

If it is necessary to stop the machine before all the sheets have passed through delivery device 1, the machine stops although there are still sheets protruding through opening 8 of delivery device 1 to outside region 6. In this context, during the transition from the third state to this fourth state of the machine, the guard is completely opened when the machine has come to rest so that the sheets can be removed from the inside of delivery device 1 and maintenance work can be carried out without difficulty. In the opposite case, during the transition from state four to state three, the guard is reclosed in a manner adapted to the sheet format and to such an extent that there is no risk of injury to the operating personnel. The transition from state four to state three occurs when the sheets protruding through opening 8 have not been removed and the machine is restarted. Before the machine starts again, the guard is then closed as a function of the format. If the paper has been removed, there is no transition from state four to state three, but state four changes to state one because now no paper is present anymore, and when the machine is restarted, state one changes to state two.

Figure 2:
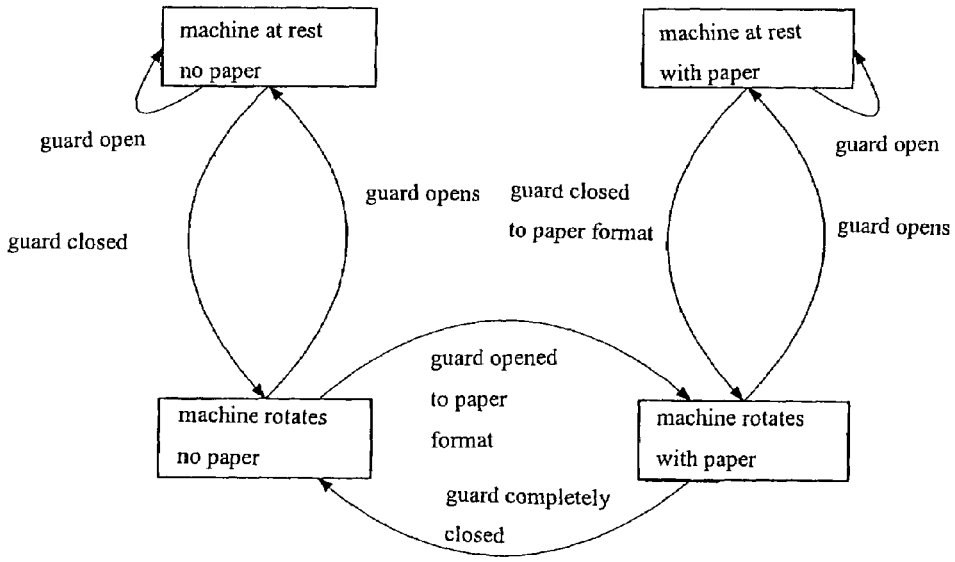
FIG. 2 shows a further flow chart of the method according to the present invention for the case that manual intervention in the closing device is possible.

The flow chart in FIG. 2 differs from the flow chart in FIG. 1 in that in states one and four, when the machine is at rest with or without paper, the guard, i.e. closing device 7, can be separately opened or closed manually or using an electrical operating control device. In this case, protective contacts at closing device 7 ensure that the machine can be put into operation again only if in state one, the guard was reclosed manually or using a push button, and if in state four, the guard was closed manually or using a push button as a function of the format.

Figure 3:
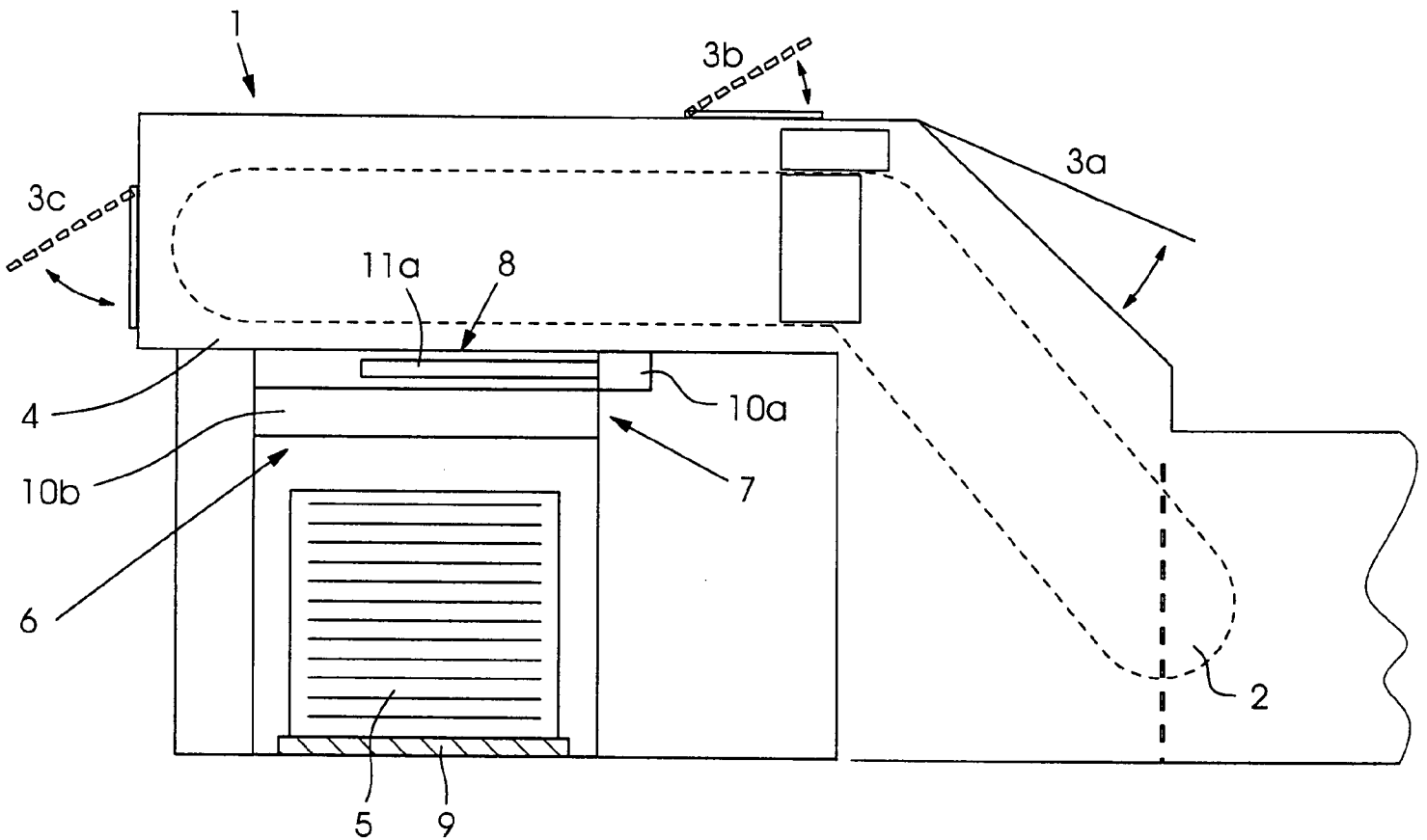
FIG. 3 is a lateral view of a delivery device of a printing press.

FIG. 3 is a schematic lateral view of a delivery device 1 of a paper-processing machine, for example, a printing press. Delivery device 1 has a drive 2, which is usually composed of rotating chains to which are attached movable gripper bridges that take the printed sheets from the last printing unit, varnishing unit or drying unit of a printing press and convey the printed sheets through the inside 4 of delivery device 1 to an opening 8, where the gripper bridges slip the sheet into the external space 6 of delivery device 1. Drive 2 may also include electric motors, pneumatic or hydraulic motors which set the chains with the gripper bridges in motion. However, it is possible for drive 2 to be composed of a coupling that couples the chains (or other device) with the gripper bridges to the drive shaft of the printing press. In this case, delivery device 1 has no separate drive, but is also driven by the main motor of the printing press or at least by the last unit of the printing press. In this context, drive 2 is located in the inside 4 of delivery device 1; the intention of this being to protect operating personnel from the moving drive 2.

For maintenance purposes, delivery device 1 has various openings that can be closed with service lids 3*a*, 3*b*, 3*c*. These openings can only be opened when drive 2 is at rest, for example, to be able to remove jammed sheets from inside 4 of delivery device 1 in case of a paper jam. Opening 8 of delivery device 1 represents the transition from the inside 4 of delivery device 1 to the externally accessible region 6 of delivery device 1. In externally accessible region 6 of delivery device 1, there is located a delivery pile 5 which is built up by the sheets that move from the inside 4 of delivery device 1 through opening 8 to outside region 6. Delivery pile 5 is built up on a pile board 9 which is adjustable in height by a lift. This is necessary in order for the top edge of delivery pile 5 to always remain at the same height, independently of whether delivery pile 5 is large or small. This means that the pile board under delivery pile 5 must be correspondingly lowered as delivery pile 5 grows.

Opening 8 of delivery device 1 can be closed using a closing device 7 to prevent the operating personnel from injury from reaching into the inside 4 of the delivery device. Closing device 7 has an electrical, pneumatic or hydraulic drive which is integrated in the machine control of the printing press, or at least in the control of drive 2 of delivery device 1. Thus, closing device 7 serves as a guard which clears opening 8 only when either the machine is at rest or sheets are conveyed from the inside 4 of the delivery device through opening 8 to externally accessible region 6. Closing device 7 is composed of three rolling shutter boxes 10*a*, 10*b*, 10*c* (FIG. 4); only two boxes being shown in the side view of FIG. 3. Roller shutters 11*a*, 11*b*, 11*c* (FIG. 4) can be moved in and out of these rolling shutter boxes as closing elements 11*a*, 11*b*, 11*c*, using drives that are present in a closing device 7. In this context, rear roller shutter 11*a* is located in a different plane than lateral roller shutters 11*b*, 11*c*. This makes it possible for lateral roller shutters 11*b*, 11*c* to be moved in and out above or below rear roller shutter 11*a*. In this manner, opening 8 can be closed as a function of the format using the three roller shutters 11*a*, 11*b*, 11*c*. Instead of the roller shutters shown here, it is also possible to use different closing elements 11*a*, 11*b*, 11*c*. Thus, for instance, plates or metal sheets that are able to laterally move in and out and to close opening 8 can be installed.

Figure 4:
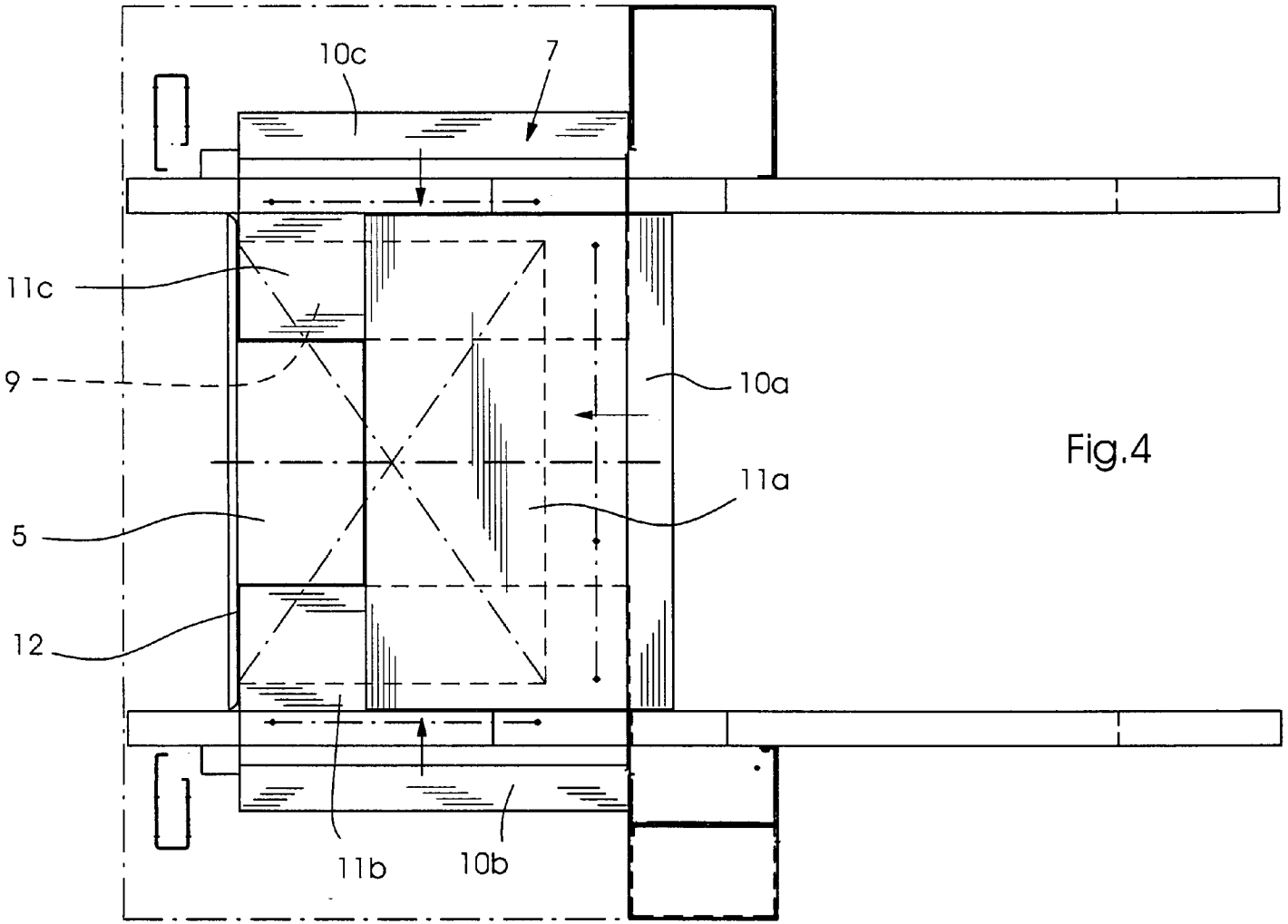
FIG. 4 shows a top view of the delivery device of a printing press.

The format-dependent closing of opening 8 by closing device 7 can be seen even better in the top view of the delivery device in FIG. 4. The top view clearly shows the arrangement of three roller shutter boxes 10*a*, 10*b*, 10*c* from which three roller shutters 11*a*, 11*b*, 11*c* can be moved out as a function of the format. In this context, a pile board 9, on which pile 5 of sheets is deposited, is plotted in dashed lines. It can be seen that the sheets on pile 5 have a much smaller format than pile board 9 and also than opening 8. Therefore, roller shutters 11*a*, 11*b*, 11*c* are moved out so far that they only leave a gap as large as the format of the sheets lying on pile 5. Since roller shutters 11*a*, 11*b*, 11*c* close opening 8 of the delivery device from below, it is thus ensured that the operating personnel have no access the inside 4 of delivery device 1. Since this is a top view, the dashed lines of lateral roller shutters 11*b*, 11*c* show that these roller shutters extend below roller shutter 11*a*.

It is, of course, possible to exchange the planes with each other or to mount roller shutters 11*a*, 11*b*, 11*c* in three different planes. In the embodiment shown here, pile 5 of printed sheets is always flush with front edge 12 of opening 8. This means that pile 5 is aligned with front edge 12 of opening 8. If pile 5 is not aligned with front edge 12 or one of the other three side edges of opening 8, an additional fourth roller shutter is required for format-dependent closure of opening 8. This is avoided if pile 5 is aligned with one of the four edges of opening 8. However, to facilitate the pulling of sample sheets, it is useful to align pile 5 with front edge 12 of opening 8 because this is where the device for pulling sample sheets is usually located.

"Substrate" as defined herein is any material to be printed.

LIST OF REFERENCE NUMERALS

1 delivery device of a printing press
2 drive of the delivery device
3*a*, 3*b*, 3*c* service lids on the delivery device
4 inside of the delivery device
5 delivery pile
6 externally accessible region
7 closing device
8 opening
9 pile board
10*a*, 10*b*, 10*c* roller shutter box
11*a*, 11*b*, 11*c* closing element/roller shutter
12 front edge of the opening

What is claimed is:

1. A method for operating a machine including a delivery device and a drive that processes printing substrates in sheet form, the method comprising:

conveying substrate sheets from an inside of the delivery device through at least one opening to an externally accessible region;

building a delivery pile in the externally accessible region using the substrate sheets coming from the inside of the delivery device through the opening;

controlling at least one closing device for opening or closing the opening via a control device operatively connected to the drive of the delivery device; and closing the opening or maintaining the opening in a closed position when no substrate sheet is conveyed through the opening.

2. The method as recited in claim 1 wherein the opening is closed or opened manually or using an operating control element; and the opening is capable of being opened only when the drive is at rest; the drive being capable of operation only when the opening is closed.

3. The method as recited in claim 1 further comprising opening the opening using the control device as soon as a substrate sheet is conveyed through the opening, or maintaining the opening in an open position when a printing substrate protrudes through the opening.

4. The method as recited in claim 3 wherein the closing device is controlled as a function of the format; and during the transport of substrate sheets, the opening is in the open position or is opened by the control device only to the extent required by a width or length of the substrate sheet.

5. The method as recited in claim 1 wherein after the drive of the delivery device has come to a stop, the opening is in an open position or is opened by the control device.

6. The method as recited in claim 1 wherein the opening is in the closed position or is closed by the control device before the drive is put into operation and when no substrate sheets protrude through the opening to the outside.

7. The method as recited in claim 4 wherein, in the case of format-dependent adjustment of the closing device, the control device opens the opening wider when the drive is at rest and the printing substrate protrudes through the opening from the inside to the outside of the delivery device.

8. The method as recited in claim 1 wherein the machine is a printing press.

9. A device for a machine that processes printing substrates in sheet form comprising:

a delivery device including a drive for conveying substrate sheets and having at least one opening, such that the substrate sheets are conveyed from an inside of the delivery device through the at least one opening to build a delivery pile in an externally accessible region, the delivery device including at least one closing device for opening or closing the opening; and a control device for controlling the closing device and being operatively connected to the drive, the control device closing the opening or maintaining the opening in a closed position when no substrate sheet is conveyed through the opening.

10. The device as recited in claim 9 further comprising sensors or contacts at the closing device to detect a state of the closing device.

11. The device as recited in claim 9 further comprising sensors or contacts for detecting substrate sheets present in a region of the closing device.

12. The device as recited in claim 9 wherein the closing device includes at least one movable closing element controllable by the control device.

13. The device as recited in claim 9 wherein the closing device includes three movable closing elements controllable by the control device.

14. The device as recited in claim 9 wherein the movable closing element is a roller shutter.

15. The device as recited in claim 9 wherein the machine is a printing press.

16. A printing press or folding machine comprising:

a delivery device including a drive for conveying substrate sheets and having at least one opening the substrate such that sheets are conveyed individually from an inside of the delivery device through the at least one opening to build a delivery pile in an externally accessible region, the delivery device including at least one closing device for opening or closing the opening; and a control device for controlling the closing device and being operatively connected to the drive, the control device closing the opening or maintaining the opening in a closed position when no substrate sheet is conveyed through the opening.

* * * * *

UNITED STATES PATENT AND TRADEMARK OFFICE

CERTIFICATE OF CORRECTION

PATENT NO. : 7,073,788 B2
APPLICATION NO. : 10/643620
DATED : July 11, 2006
INVENTOR(S) : Markus Donges et al.

It is certified that error appears in the above-identified patent and that said Letters Patent is hereby corrected as shown below:

In claim 9, lines 4 and 5 should read: --. . .and having at least one opening such that the substrate sheets are conveyed individually from an inside. . .-- instead of ". . .and having at least one opening, such that the substrate sheets are conveyed from an inside. . .".

In claim 16, lines 3 and 4 should read: --. . .and having at least one opening such that the substrate sheets are conveyed individually. . .-- instead of ". . .and having at least one opening the substrate such that sheets are conveyed individually. . .".

Signed and Sealed this

Sixteenth Day of January, 2007

JON W. DUDAS
*Director of the United States Patent and Trademark Office*